US012649093B2

(12) United States Patent
Kachiwazaki et al.

(10) Patent No.: US 12,649,093 B2
(45) Date of Patent: Jun. 9, 2026

(54) FLEXIBLE PICKLEBALL PADDLE AND FRAME THEREOF

(71) Applicant: Sport Squad, Inc., North Bethesda, MD (US)

(72) Inventors: Fabio Kachiwazaki, São Paulo (BR); Richard Lee, Potomac, MD (US); Austin Kim, Columbia, MD (US)

(73) Assignee: Sport Squad, Inc., North Bethesda, MD (US)

( * ) Notice: Subject to any disclaimer, the term of this patent is extended or adjusted under 35 U.S.C. 154(b) by 0 days.

(21) Appl. No.: 19/214,585

(22) Filed: May 21, 2025

(65) Prior Publication Data

US 2025/0319371 A1 Oct. 16, 2025

Related U.S. Application Data

(63) Continuation of application No. PCT/US2025/023898, filed on Apr. 9, 2025.
(Continued)

(51) Int. Cl.
*A63B 59/42* (2015.01)
*A63B 60/06* (2015.01)
(Continued)

(52) U.S. Cl.
CPC ..... *A63B 59/42* (2015.10); *A63B 60/06* (2015.10); *A63B 60/52* (2015.10); *A63B 60/54* (2015.10); *A63B 2102/08* (2015.10)

(58) Field of Classification Search
CPC ..... A63B 60/54; A63B 49/02; A63B 49/03; A63B 60/08; A63B 60/06; A63B 60/52;
(Continued)

(56) References Cited

U.S. PATENT DOCUMENTS 3,840,230 A * 10/1974 Schaefer ..... A63B 49/10 273/DIG. 7
3,879,035 A 4/1975 Danchulis et al.
(Continued)

FOREIGN PATENT DOCUMENTS

AR 245895 A1 3/1994
AR 085719 10/2013
(Continued)

OTHER PUBLICATIONS

CN 101185805 A (Year: 2008).*
(Continued)

*Primary Examiner* — John E Simms, Jr.
*Assistant Examiner* — Amir A Klayman
(74) *Attorney, Agent, or Firm* — Bass Patent Law, LLC

(57) ABSTRACT

The present teachings generally include flexible pickleball paddles and/or frames thereof. In an aspect, a frame of a paddle includes a region adjacent to a throat portion of the paddle that is thinner than other regions of the frame, e.g., thicker regions disposed along its sides, top, and/or handle. The lack of material in this portion of the frame—e.g., disposed directly above the handle—may provide advantageous flexing of the paddle during play (e.g., how fast the paddle can return to the original shape after being flexed), improving power characteristics, control, feel, responsiveness, and/or the like. Moreover, a gap formed by the lack of material in this portion of the frame can provide a region for enhanced weight control (e.g., by filling the gap with a weighted material), and/or for enhanced sound or vibration control (e.g., by filling the gap with a sound dampening and/or vibration dampening material).

20 Claims, 7 Drawing Sheets

Related U.S. Application Data

(60) Provisional application No. 63/634,184, filed on Apr. 15, 2024.

(51) Int. Cl.
*A63B 60/52* (2015.01)
*A63B 60/54* (2015.01)
*A63B 102/08* (2015.01)

(58) Field of Classification Search
CPC . A63B 60/50; A63B 59/40; A63B 2049/0211; A63B 2102/00; A63B 53/0416; A63B 59/42; A63B 49/08; A63B 2102/08
See application file for complete search history.

(56) References Cited

U.S. PATENT DOCUMENTS 3,879,250 A 4/1975 Rankin, Jr.
3,949,988 A 4/1976 Staufer
3,998,457 A * 12/1976 Dempsey ..... A63B 49/12 473/535
4,062,541 A 12/1977 Marks
4,130,277 A 12/1978 Marks
4,192,506 A 3/1980 Sofia
4,194,738 A 3/1980 Inoue et al.
4,227,692 A 10/1980 Castelli
4,331,331 A 5/1982 Rodgers, Jr.
4,379,554 A 4/1983 Schuyler et al.
4,903,967 A * 2/1990 Ferrari ..... A63B 49/022 473/546
5,029,858 A 7/1991 Chen
5,172,911 A 12/1992 Chang
5,219,166 A 6/1993 Chang
5,326,097 A * 7/1994 Yu ..... A63B 60/40 473/528
5,454,562 A 10/1995 Sommer
5,458,331 A 10/1995 Bothwell
5,560,600 A * 10/1996 FitzSimons ..... A63B 49/03 473/531
5,649,873 A 7/1997 Shannon
5,961,404 A * 10/1999 Gormley ..... A63B 59/48 473/530
6,537,164 B1 * 3/2003 Hsu ..... A63B 60/54 473/546
6,969,329 B2 * 11/2005 Popovich ..... A63B 60/34 473/527
6,974,397 B2 * 12/2005 Lammer ..... A63B 49/02 473/546
7,967,706 B2 * 6/2011 Cottey ..... A63B 49/02 473/546
8,371,968 B2 2/2013 Gazzara et al.
8,814,731 B2 * 8/2014 Jennings ..... A63B 60/26 473/549
9,993,707 B2 6/2018 Davis
10,207,164 B2 2/2019 Hsu et al.
10,377,093 B2 8/2019 Filippini
11,597,169 B2 3/2023 Simmons
11,612,792 B2 * 3/2023 Marshall ..... A63B 60/06 473/527
D1,016,196 S 2/2024 Barnes et al.
D1,020,945 S 4/2024 Barnes et al.
12,257,486 B1 3/2025 Myrhum
12,263,387 B1 4/2025 Goryachkin
12,357,891 B2 7/2025 Kachiwazaki et al.
12,370,424 B1 7/2025 Kim
12,465,826 B2 11/2025 Kachiwazaki et al.
12,465,827 B2 11/2025 Gosselin et al.
2003/0069096 A1 4/2003 Lin
2004/0063519 A1 4/2004 Liberatore
2006/0054258 A1 3/2006 Lamparello et al.
2011/0201461 A1 8/2011 Gazzara et al.
2013/0331209 A1 * 12/2013 Jennings ..... A63B 60/26 473/549
2015/0224370 A1 8/2015 Yamamoto
2016/0107053 A1 4/2016 Pree
2016/0367875 A1 12/2016 Lammer et al.
2017/0021247 A1 1/2017 Marvin
2017/0021248 A1 * 1/2017 Marvin ..... A63B 59/45
2017/0136325 A1 * 5/2017 Fox ..... A63B 59/42
2018/0104555 A1 * 4/2018 Taylor ..... A63B 59/45
2018/0353820 A1 12/2018 Davis
2020/0290243 A1 9/2020 Avnery et al.
2020/0360778 A1 11/2020 Lee
2020/0398130 A1 12/2020 Lee
2021/0252356 A1 * 8/2021 Thurman ..... A63B 59/42
2021/0252357 A1 8/2021 Lee
2021/0260452 A1 8/2021 Zheng
2022/0032141 A1 2/2022 Brents et al.
2022/0040937 A1 * 2/2022 Simmons ..... B29C 70/68
2022/0273997 A1 * 9/2022 Zheng ..... A63B 60/08
2023/0047371 A1 2/2023 Lee
2023/0149784 A1 5/2023 Lee
2023/0191215 A1 6/2023 Barnes et al.
2023/0293961 A1 9/2023 Haut
2023/0356048 A1 11/2023 Junkins
2023/0415010 A1 12/2023 Luo
2024/0009532 A1 1/2024 Liu et al.
2024/0017141 A1 1/2024 Filippini
2024/0050822 A1 2/2024 Kapheim
2024/0165468 A1 * 5/2024 Shu ..... A63B 59/42
2024/0252894 A1 8/2024 Kowalski
2024/0286014 A1 8/2024 Marks et al.
2024/0286015 A1 8/2024 Junkins
2024/0390753 A1 11/2024 Haugom et al.
2024/0424366 A1 12/2024 Li
2025/0018264 A1 1/2025 Filippini
2025/0041685 A1 2/2025 Paselk et al.
2025/0041686 A1 2/2025 Paselk et al.
2025/0073549 A1 3/2025 Kachiwazaki et al.
2025/0073550 A1 3/2025 Werneke
2025/0083010 A1 3/2025 Meyer et al.
2025/0090914 A1 3/2025 Young
2025/0114674 A1 4/2025 Hudes
2025/0161771 A1 5/2025 Kachiwazaki et al.
2025/0161772 A1 5/2025 Kachiwazaki et al.
2025/0170467 A1 5/2025 Reinhall et al.
2025/0177829 A1 6/2025 Paselk et al.
2025/0186845 A1 6/2025 Zeng et al.
2025/0213941 A1 7/2025 Yu
2025/0242218 A1 7/2025 Thompson et al.
2025/0269253 A1 8/2025 Barnes et al.
2025/0269255 A1 8/2025 Dinan
2025/0276225 A1 9/2025 Junkins
2025/0288878 A1 9/2025 Barnes
2025/0295967 A1 9/2025 Zheng
2025/0303246 A1 10/2025 Yamashita et al.
2025/0312666 A1 * 10/2025 Severa ..... A63B 60/08
2025/0312667 A1 10/2025 Li
2025/0319371 A1 10/2025 Kachiwazaki et al.
2025/0319372 A1 10/2025 Xue
2025/0345676 A1 11/2025 Chang
2025/0345678 A1 11/2025 Stroh
2025/0354307 A1 11/2025 Haugom et al.
2026/0000949 A1 1/2026 Eisele et al.
2026/0000950 A1 1/2026 Kachiwazaki et al.
2026/0014434 A1 1/2026 Chang
2026/0014435 A1 1/2026 Dinan
2026/0014436 A1 1/2026 Kachiwazaki et al.
2026/0021360 A1 1/2026 Shih

FOREIGN PATENT DOCUMENTS

AT 390564 B * 5/1990 ..... A63B 49/03
CA 3038087 A 9/2020
CN 101185805 A * 5/2008
CN 201157655 Y * 12/2008
CN 202161771 U 3/2012
CN 104707310 A * 6/2015
CN 205699255 U 11/2016
CN 107890649 A 4/2018
CN 209934006 U 1/2020
CN 108325183 B * 5/2020 ..... A63B 59/42

(56) References Cited

FOREIGN PATENT DOCUMENTS

| | | | |
|---|---|---|---|
| CN | 219167665 | U | 6/2023 |
| CN | 219208922 | U | 6/2023 |
| CN | 219701015 | U | 9/2023 |
| CN | 219941732 | U | 11/2023 |
| CN | 308857092 | S | 9/2024 |
| DE | 1904957 | A1 | 8/1970 |
| DE | 2721715 | A1 | 12/1977 |
| DE | 3716708 | A1 | 12/1988 |
| DE | 10161835 | A1 | 7/2003 |
| EP | 0461561 | A1 | 12/1991 |
| EP | 3305378 | A1 | 4/2018 |
| ES | 1055113 | U | 10/2003 |
| ES | 2395181 | A1 | 2/2013 |
| JP | 2023065864 | A | 5/2023 |
| KR | 910016433 | A | 11/1991 |
| KR | 20090010243 | A | 1/2009 |
| TW | M645443 | U | 8/2023 |
| WO | 2012089931 | A1 | 7/2012 |
| WO | 2022182992 | A1 | 9/2022 |
| WO | 2022217045 | A1 | 10/2022 |
| WO | 2023114486 | A1 | 6/2023 |
| WO | 2024076417 | A1 | 4/2024 |
| WO | 2025019567 | A1 | 1/2025 |
| WO | 2025049122 | A1 | 3/2025 |
| WO | 2025090772 | A1 | 5/2025 |
| WO | 2025189233 | A1 | 9/2025 |
| WO | 2025194024 | A1 | 9/2025 |
| WO | 2025221519 | A1 | 10/2025 |
| WO | 2025235676 | A1 | 11/2025 |
| WO | 2025244690 | A1 | 11/2025 |
| WO | 2026006684 | A1 | 1/2026 |

OTHER PUBLICATIONS

CN 104707310 A (Year: 2015).*
CN 108325183 B (Year: 2020).*
CN 201157655 Y (Year: 2008).*
AT 390564 B (Year: 1990).*
ISA, EPO, PCT Application No. PCT/US25/23898, International Search Report and Written Opinion dated Jul. 29, 2025, 17 pages.
Adidas Technologies, What technologies do we use in adidas paddle rackets? The Best Technologies At Your Disposal, 2024, 6 pages.
CNIPA, Chinese Application No. 202560001249.X, (International Reg. No. DM/246638), Notification of Refusal dated Oct. 30, 2025, 3 pages.
CNIPA, Cn Patent No. ZL2024221105356, Utility Model Patent Evaluation Report dated Nov. 11, 2025.
EPO, "EP Application No. 25201588.8, Examination Report Dated Dec. 12, 2025, 6 pages".
EPO, EP Application No. 25201588.8, EP Search Report dated Dec. 1, 2025, 5 pages.
Gearbox, "Pro Power Elongated," https://gearboxsports.com/collections/all-pickleball-paddles/products/pro-power-elongated, 2023, 9 pages.
Image of cutaway of Selkirk LABS Project 002 paddle (Aug. 2023), 1 page.
ISA/EP, PCT Application No. PCT/US25/23730, Invitation to Pay Additional Fees dated Jul. 29. 2025, 13 pages.
ISA/EP, "PCT Application No. PCT/US25/23730, International Search Report dated Sep. 19, 2025, 18 pages".
ISA/EP, PCT Application No. PCT/US24/42535, International Search Report and Written Opinion dated Nov. 12, 2024, 15 pages.
JOOLA Store, "JOOLA Ben Johns Hyperion 3S 16mm Pickleball Paddle", Date first available: Sep. 8, 2024, https://joola.com/products/ben-johns-hyperion-3s-16mm-pickleball-paddle, 3 pages.
JOOLA Store, "JOOLA Perseus 3S Dual 16mm Pickleball Paddle", Date first available: Aug. 18, 2025, https://joola.com/products/joola-perseus-3s-dual-16mm-pickleball-paddle, 7 pages.
JOOLA Store, "JOOLA Scorpeus 3S Dual 14mm Pickleball Paddle", Date first available: Aug. 18, 2025, https://joola.com/products/joola-scorpeus-3s-dual-14mm-pickleball-paddle, 7 pages.
Selkirk LABS Project 002, website captured by Wayback Machine on Jun. 2, 2022, currently available at https://www.selkirklabs.com/products/selkirk-labs-project-002 (website capture date is Jun. 2, 2022), 3 pages.
The Drink Media Team on Mar. 28, 2023, Engage Pursuit ULTRA Paddles: Technology Without Boundaries-The Drink Pickleball, 7 pages.
The Wayback Machine, Adidas Technologies, 2022, The Best Technologies at Your Disposal, 12 pages.
USPTO, "U.S. Appl. No. 19/027,671, Notice of Allowance dated Oct. 15, 2025, 6 pages".
USPTO, U.S. Appl. No. 19/027,671, Non-Final Office Action dated Apr. 4, 2025, 29 pages.
USPTO, U.S. Appl. No. 19/027,671, Final Office Action dated Jul. 24, 2025, 23 pages.
USPTO, U.S. Appl. No. 19/028,832, Non-Final Office Action dated Mar. 12, 2025, 15 pages.
USPTO, U.S. Appl. No. 19/028,832, Notice of Allowance dated Apr. 9, 2025, 9 pages.
USPTO, U.S. Appl. No. 19/336,408, Non-Final Office Action dated Dec. 4, 2025, 10 pages.
WIPO | HAGUE, International Reg. No. DM246638, Notification of Refusal from IP Viet Nam dated Dec. 2, 2025, 3 pages.
Youtube, Combat Pickleball. "First Ever interchangeable pickleball paddle—Order Now!", available at https://www.youtube.com/watch?v=IfghM_G4Cc0 (posted on Nov. 26, 2025), 3 pages.
ISA, US, PCT Application No. PCT/US2026/015561, International Search Report and Written Opinion dated Apr. 6, 2026, 18 pages.

* cited by examiner

FLEXIBLE PICKLEBALL PADDLE AND FRAME THEREOF

CROSS-REFERENCE TO RELATED APPLICATIONS

This application is a bypass continuation that claims priority to International Patent Application No. PCT/US25/23898 filed on Apr. 9, 2025, which claims priority to U.S. Provisional Pat. App. No. 63/634,184 filed on Apr. 15, 2024, where each of the foregoing applications are hereby incorporated by reference in their entirety.

FIELD

The present disclosure generally relates to a flexible pickleball paddle and/or a flexible frame for a pickleball paddle, and similar.

BACKGROUND

Pickleball is a paddle sport that generally combines elements of tennis, badminton, and ping-pong. It is played on a court with similar dimensions to a badminton court with a net dividing opposing sides. The game is played with a perforated plastic ball and paddles made of, for example, wood, graphite, and/or composite materials. In general, players use their paddles to hit the ball over the net, aiming to land the ball within the boundaries of the opposing side of the court.

Pickleball paddles, while seemingly simple, have several important features that can significantly impact a player's performance, including the materials used, the weight, the particular construction configuration, and the size and shape thereof. Such features can impact play characteristics such as one or more of durability, power, control, feel, sweet spot, responsiveness, noise, vibration, and the like. There remains a need for improved pickleball paddles and frames thereof.

SUMMARY

The present teachings generally include flexible pickleball paddles and/or frames thereof. In an aspect, a frame of a paddle includes a region adjacent to a throat portion of the paddle that is thinner than other regions of the frame, e.g., thicker regions disposed along its sides, top, and/or handle. The lack of material in this portion of the frame—e.g., disposed directly above the handle—may provide advantageous flexing of the paddle during play (e.g., how fast the paddle can return to the original shape after being flexed), improving power characteristics, control, feel, responsiveness, and/or the like. Moreover, a gap formed by the lack of material in this portion of the frame can provide a region for enhanced weight control (e.g., by filling the gap with a weighted material), and/or for enhanced sound or vibration control (e.g., by filling the gap with a sound dampening and/or vibration dampening material).

In an example aspect, a pickleball paddle disclosed herein includes: a handle including a top end and a bottom end; a first face and a second face that opposes the first face, each of the first face and the second face extending from a throat portion engaged with the top end of the handle, and each of the first face and the second face structurally configured for striking a ball; and a frame disposed between the first face and the second face along at least a portion of a perimeter of the paddle. The frame may at least partially define a shape of the perimeter of the paddle, and the frame may include:

a first portion disposed above the throat portion along a first side, a second side, and a top side of the paddle, the first portion having a first thickness; and a second portion disposed adjacent to the throat portion along the first side and the second side of the paddle, the second portion coupling the first portion and the top end of the handle, and the second portion having a second thickness that is less than the first thickness.

Implementations of this example aspect, or any other example aspect described in this summary section or otherwise herein, may include one or more of the following features. The second thickness may be selected to provide a predetermined flex between the top side of the paddle and the bottom end of the handle when a predetermined force is applied normal to one of the first face and the second face. The second thickness of the second portion may define one or more gaps between the first face and the second face along an edge portion of the paddle. At least one of the one or more gaps may include a filler material at least partially filling the at least one of the one or more gaps. The filler material may include a material structurally configured to dampen vibration of the paddle when striking the ball. The filler material may include a material structurally configured to dampen sound of the paddle striking the ball. The paddle may include an edge guard disposed over at least part of the second portion of the frame, the edge guard defining a void exposing at least one of the one or more gaps along the edge portion of the paddle. The paddle may include an edge guard disposed over at least a portion of one or more of the first portion of the frame and the second portion of the frame. The paddle may include a first transition region disposed between the first portion and the second portion. The first transition region may include a sloped portion. The first transition region may include one or more cutouts forming at least one step between the first thickness and the second thickness. The frame may include a handle portion forming at least part of the top end of the handle. The handle portion may be thicker than the second thickness. The handle portion may include the first thickness. The paddle may include a second transition region disposed between the second portion and the handle portion. The second transition region may include a sloped portion. The second transition region may include one or more cutouts forming at least one step between the second portion and the handle portion. The second thickness may be formed by removal of material from the frame along the second portion. The second thickness may be formed by an absence of material from the frame along the second portion. The second thickness may be formed by preventing expansion of material disposed within the second portion during a manufacturing process.

In an example aspect, a frame for a pickleball paddle disclosed herein includes: a handle portion structurally configured to form at least part of a handle of the pickleball paddle; a first portion disposed above the handle portion, the first portion forming at least part of a first side, a second side, and a top side to define at least part of a shape of a perimeter of the pickleball paddle, the first portion having a first thickness; and a second portion disposed between and coupling the first portion and the handle portion, the second portion having a second thickness that is less than the first thickness.

In an example aspect, a frame for a pickleball paddle disclosed herein includes: a handle portion structurally configured to form at least part of a handle of the pickleball paddle; a first portion disposed above the handle portion, the first portion forming at least part of a first side and a second side of the pickleball paddle, the first portion having a first elasticity along at least part of the first side and the second side of the pickleball paddle; and a second portion disposed between and coupling the first portion and the handle portion, at least part of the second portion having a second elasticity that is greater than the first elasticity.

Implementations of this example aspect, or any other example aspect described in this summary section or otherwise herein, may include one or more of the following features. The first portion may be made from the same material as the second portion, and the first elasticity being less than the second elasticity may be provided by a difference in one or more of a size and a shape between the first portion and the second portion. The difference in one or more of the size and the shape between the first portion and the second portion may be formed by removal of material along the second portion. The difference in one or more of the size and the shape between the first portion and the second portion may be formed by preventing expansion of material disposed within the second portion during a manufacturing process. The first portion may include a first material and the second portion may include a second material that is different than the first material, the second material having the second elasticity that is greater than the first elasticity of the first material.

In an example aspect, a pickleball paddle disclosed herein includes a body including: a first side; a second side opposing the first side; a top side; and a bottom side opposing the top side, the bottom side structurally configured for engagement with a top end of a handle portion. The paddle may also include a neck region extending upwards from the bottom side of the body, and a first portion of the body disposed above the neck region, the first portion having a first elasticity, and at least a portion of the neck region having a second elasticity that is greater than the first elasticity.

Implementations of this example aspect, or any other example aspect described in this summary section or otherwise herein, may include one or more of the following features. The paddle may include a frame coupled to the body. The paddle may include a first face and a second face each engaged with the body. The first portion may be made from the same material as the portion of the neck region having the second elasticity, and the first elasticity being less than the second elasticity may be provided by a difference in one or more of a size and a shape between the first portion and the portion of the neck region having the second elasticity. The difference in one or more of the size and the shape between the first portion and the portion of the neck region having the second elasticity may be formed by removal of material along at least one of: the first side, the second side, a top surface, and a bottom surface. The difference in one or more of the size and the shape between the first portion and the portion of the neck region having the second elasticity may be formed by preventing expansion of material disposed within the portion of the neck region during a manufacturing process. The first portion may include a first material and the portion of the neck region may include a second material that is different than the first material, the second material having the second elasticity that is greater than the first elasticity of the first material. The first portion may include a first material and the portion of the neck region lacks the first material, the first material providing for the first elasticity of the first portion. At least a part of the bottom side of the body may include the neck region. At least a part of the bottom side of the body may include one or more portions having the first elasticity. The body may include at least the top end of the handle portion. The body may include the handle portion. At least part of the handle portion may include an elasticity that is less than the second elasticity. The first portion may extend to the top side of the body.

In an example aspect, a pickleball paddle disclosed herein includes a body including: a first side; a second side opposing the first side; a top side; and a bottom side opposing the top side, the bottom side structurally configured for engagement with a top end of a handle portion. The paddle may also include a neck region extending upwards from the bottom side of the body, and a first portion of the body disposed above the neck region, the first portion having a first elasticity, and at least a portion of the neck region having a second elasticity that is different than the first elasticity. The second elasticity may be greater than the first elasticity. The second elasticity may be less than the first elasticity.

In an example aspect, a pickleball paddle disclosed herein includes a body including: a first side; a second side opposing the first side; a top side; and a bottom side opposing the top side, the bottom side structurally configured for engagement with a top end of a handle portion. The paddle may also include a neck region extending upwards from the bottom side of the body, and a first portion of the body disposed above the neck region, the first portion having a first thickness, and at least a portion of the neck region having a second thickness that is different than the first thickness. The second thickness may be greater than the first thickness. The second thickness may be less than the first thickness.

In an example aspect, a method of forming a paddle disclosed herein includes forming a frame at least partially defining a shape of a perimeter of the paddle, the frame including: a throat portion; a first portion disposed above the throat portion along a first side, a second side, and a top side of the paddle, the first portion having a first thickness; and a second portion disposed adjacent to the throat portion along the first side and the second side of the paddle, the second portion having a second thickness that is less than the first thickness. The method may also include: coupling the throat portion of the frame to a top end of a handle; and disposing the frame between a first face and a second face along at least a portion of the perimeter of the paddle, each of the first face and the second face structurally configured for striking a ball. The method may include defining one or more gaps between the first face and the second face along the second portion of the frame. The method may include at least partially filling at least one of the one or more gaps with a filler material.

These and other features, aspects, and advantages of the present teachings will become better understood with reference to the following description, examples, and appended claims.

BRIEF DESCRIPTION OF THE DRAWINGS

The foregoing and other objects, features and advantages of the devices, systems, and methods described herein will be apparent from the following description of particular embodiments thereof, as illustrated in the accompanying drawings. The drawings are not necessarily to scale, emphasis instead being placed upon illustrating the principles of the devices, systems, and methods described herein. In the drawings, like reference numerals generally identify corresponding elements.

DETAILED DESCRIPTION

Figure 1:
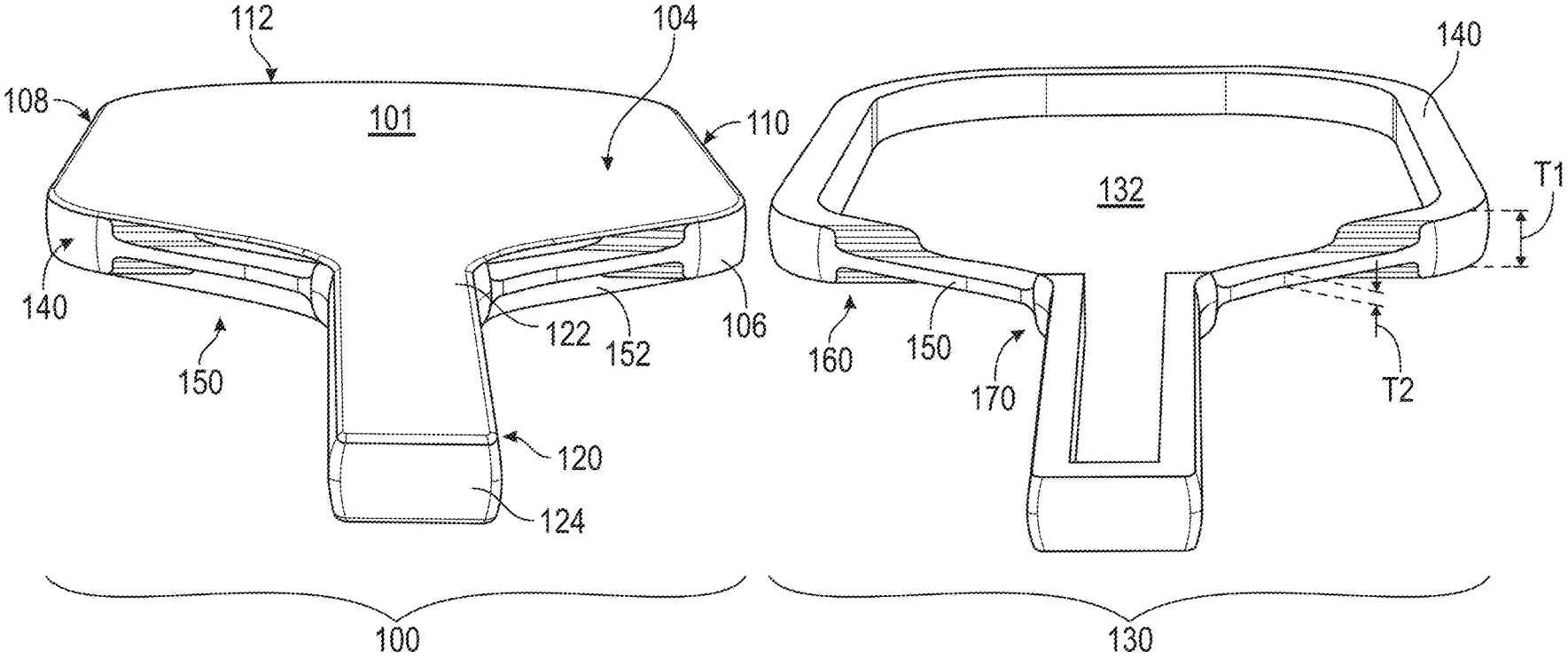
FIG. 1 shows a pickleball paddle and frame, in accordance with a representative example.

The embodiments will now be described more fully hereinafter with reference to the accompanying figures, in which preferred embodiments are shown. The foregoing may, however, be embodied in many different forms and should not be construed as limited to the illustrated embodiments set forth herein. Rather, these illustrated embodiments are provided so that this disclosure will convey the scope to those skilled in the art.

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately" or the like, when accompanying a numerical value, are to be construed as indicating a deviation as would be appreciated by one of ordinary skill in the art to operate satisfactorily for an intended purpose. Similarly, words of approximation such as "about," "approximately," or "substantially" when used in reference to physical characteristics, should be understood to contemplate a range of deviations that would be appreciated by one of ordinary skill in the art to operate satisfactorily for a corresponding use, function, purpose, or the like. Ranges of values and/or numeric values are provided herein as examples only, and do not constitute a limitation on the scope of the described embodiments. Where ranges of values are provided, they are also intended to include each value within the range as if set forth individually, unless expressly stated to the contrary. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

In the following description, it is understood that terms such as "first," "second," "top," "bottom," "up," "down," and the like, are words of convenience and are not to be construed as limiting terms unless specifically stated to the contrary.

In general, the devices, systems, kits, and methods disclosed herein relate to flexible pickleball paddles and/or frames thereof. Specifically, in certain implementations, a frame that at least partially defines the shape of a pickleball paddle (e.g., a frame disposed along a perimeter of the paddle, and/or that itself forms at least a portion of the perimeter of the paddle) includes a region adjacent to a throat portion of the paddle that is thinner relative to other regions of the frame, e.g., thicker regions disposed along its sides, top, and/or handle. The lack of material in this portion of the frame—e.g., a portion disposed directly above the handle of the paddle—may provide advantageous flexing of the paddle during play, improving one or more of power characteristics, control, feel, responsiveness, sweet spot, noise, vibration, and/or the like. For example, a pickleball paddle (and/or a frame thereof) according to the present teachings may provide advantages related to, and stemming from, how fast the paddle can return to its original shape after being flexed. In other words, embodiments described herein according to the present teachings may be able to flex and return to an original shape in a relatively fast and efficient manner when compared to other paddles. Moreover, a gap formed by the lack of material in this portion of the frame can provide a region for enhanced weight control—e.g., a manufacturer and/or player can fill the gap with a weighted material, or choose to leave the gap empty to provide a lighter paddle. The gap can also or instead provide for enhanced sound control and/or vibration control—e.g., by filling the gap with a sound dampening material and/or a vibration dampening material. In some aspects, the gap can also or instead serve an aesthetic purpose, with or without material added thereto.

While a flexible paddle itself may not necessarily increase power, it may be able to considerably alter and/or control characteristics such as power, control, feel, and sweet spot, which can be beneficial to players. And for thermoformed paddles, the frame can be manipulated to provide for different flexibility and stiffness of the paddle. By way of example and as explained herein, a pickleball paddle may include a frame that has a void in a central portion thereof, where this void can be filled wholly or partially with elements to form a desired core of the pickleball paddle—e.g., where the core includes advantageous features and materials for enhanced play. For example, the paddle may be similar to that described in Int'l Pat. App. Pub. No. WO2025/049122, which is incorporated by reference herein. In this manner, the frame may at least partially define a perimeter of a pickleball paddle, where the shape of the frame in certain areas can be designed to provide certain play characteristics. For example, the frame may include a cutout region formed by a thinner portion relative to other portions of the frame, where it will be understood that this cutout region may be formed by removal of material from this region and/or by other manufacturing techniques that can create a cutout shape (e.g., by using less material, by omitting material, by preventing expansion of material within this region during manufacturing). And in some aspects, this thinner portion is formed in the neck area of the frame (i.e., an area adjacent to a throat portion of a pickleball paddle), where a frame formed in this manner can have advantageous flexibility. Further, gaps formed by the lack of material can be hidden inside the paddle (e.g., beneath an edge guard) or exposed (e.g., with or without an edge guard disposed outside the gaps). It is also or instead possible to add one or more of a vibration dampening material and/or a sound dampening material within such a gap.

It will be understood that, while this disclosure may emphasize the present teachings in the context of pickleball, the present teachings may be adapted and practiced in other sports and activities, including without limitation one or more of: tennis, badminton, squash, racquetball, table tennis (ping pong), and the like. Thus, it shall be understood that, unless expressly stated to the contrary, or otherwise clear from the context, the present teachings is intended to include comparable equipment in other sports/activities in addition to, or instead of, pickleball.

Figure 2:
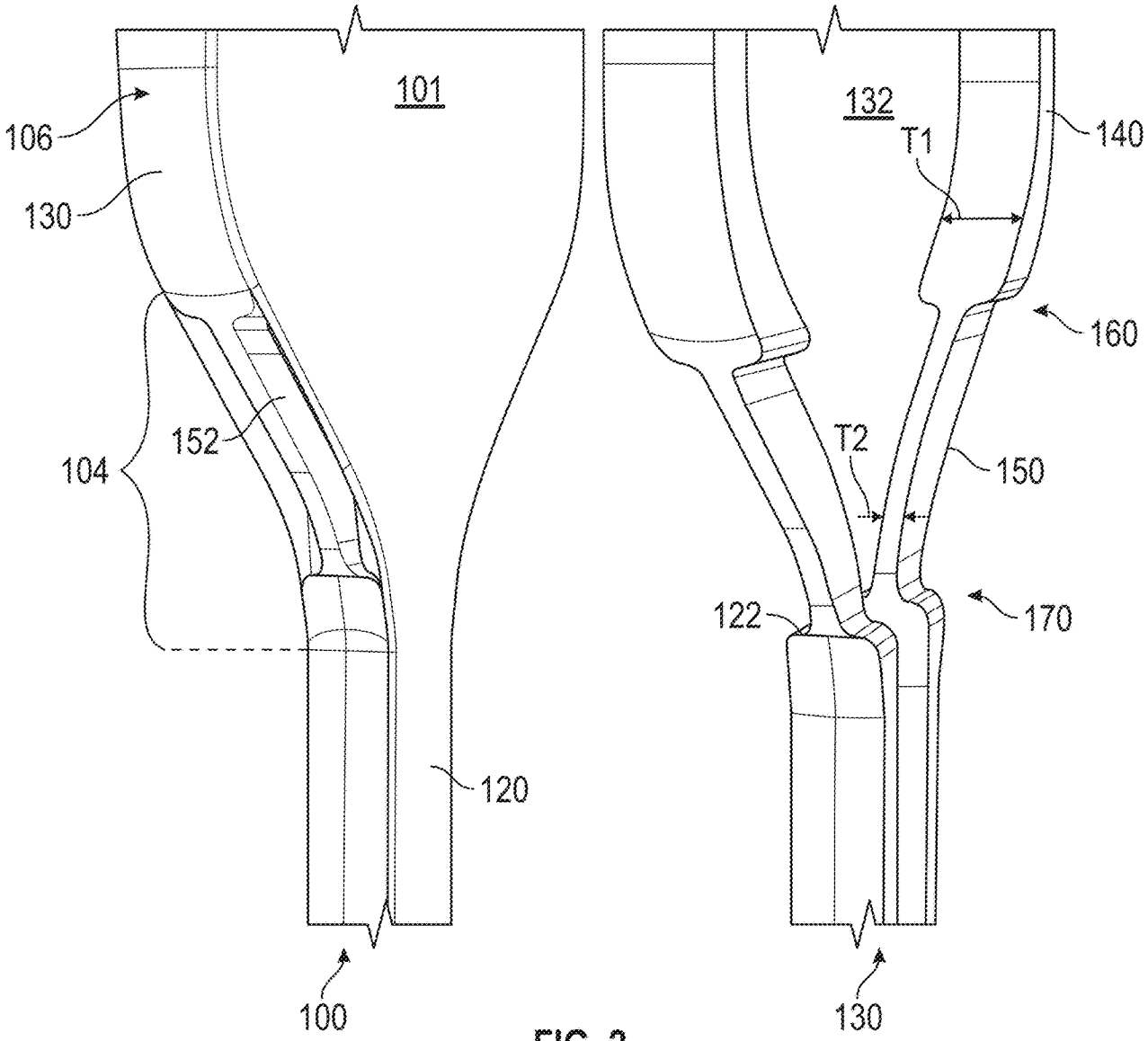
FIG. 2 shows a pickleball paddle and frame, in accordance with a representative example.

FIGS. 1 and 2 show a pickleball paddle 100 and a frame 130, in accordance with a representative example. The paddle 100 may generally include a handle 120, a first face 101 and a second face that opposes the first face 101, a throat portion 104, and an edge portion 106 along at least a first side 108, a second side 110, and a top side 112 of the paddle 100. The paddle may further include a frame 130, which can provide for desired flexibility enhancements as described herein. It will be understood that the paddle 100 is shown for the sake of simplicity and understanding of the present teachings, without additional features that may be included to provide a complete paddle, such as handle foam, handle grips, an end cap, an edge guard, and the like.

The handle 120 may include a top end 122 and a bottom end 124. As shown in the figures, the frame 130 may form at least a portion of the handle 120, e.g., along one or more of the top end 122 and the bottom end 124 thereof. In certain other aspects, the frame 130 is absent from at least some of the handle 120.

The first face 101 and the second face (which is not shown in FIGS. 1 and 2, but would be disposed on the opposite face of the paddle 100, as the second face opposes the first face 101) may each extend from the throat portion 104 (e.g., extending toward the top side 112), which may be engaged with the top end 122 of the handle 120. Thus, the throat portion 104 may be disposed along the same plane as the faces of the paddle 100, and may itself be a lower portion of the faces of the paddle 100. Each of the first face 101 and the second face may be structurally configured for striking a ball.

The frame 130 may be disposed between the first face 101 and the second face. The frame 130 may further be disposed along at least a portion of a perimeter of the paddle 100, where the frame 130 at least partially defines the shape of the perimeter of the paddle 100. For example, the frame 130 itself may form at least part of the perimeter of the paddle 100, and in some instances, the frame 130 defines the entire perimeter of the paddle 100. The frame 130 may define a central void 132, which can be filled with one or more materials and/or components to create a core of the paddle 100. During assembly of the paddle 100, each of the first face 101 and the second face may be coupled (e.g., adhered directly to) the frame 130.

It will be understood that, although the frame 130 is shown with a central void 132, it is also or instead possible to have a substantially solid frame, e.g., that forms a substantial portion of the shape of a finished paddle. In the context of the present teachings, such a substantially solid frame, or a frame otherwise lacking a core portion (e.g., lacking a central void 132, or containing a central void 132 within an otherwise solid structure that forms more than just a perimeter of a paddle), may include one or more cutouts in the neck area (e.g., adjacent to, or disposed under, a throat portion and/or in a side adjacent the throat portion) and/or other material characteristics in the neck area to provide enhanced flexibility as described herein. That is, the present teachings can be adapted to provide for paddles lacking a central void 132, and/or for paddles otherwise including more robust frames than those shown in FIGS. 1 and 2, and/or for paddles completely lacking frames.

The frame 130 may include a first portion 140 and a second portion 150. In general, and as described in more detail below, the first portion 140 may include more material than the second portion 150—e.g., it may be thicker than the second portion 150. And in general, the second portion 150 may be strategically positioned to provide a predetermined flexibility for the paddle 100, where such flexibility is either greater than or less than flexibility for the paddle 100 that would be present if the frame 130 lacked both the first and second portions as described herein.

The first portion 140 of the frame 130 may be generally disposed above the throat portion 104. Specifically, in certain aspects, the first portion 140 may be disposed along at least a portion of each of the first side 108, the second side 110, and the top side 112 of the paddle 100. The first portion 140 may include a first thickness T1, measured in the direction between the first face 101 and the second face. That is, in some aspects, a majority of the first portion 140 (e.g., all of the first portion 140) may be formed having at least the first thickness T1. For example, portions of the frame 130 that are disposed along each of the first side 108, the second side 110, and the top side 112 of the paddle 100 may include at least some portions having at least the first thickness T1.

The second portion 150 of the frame 130 may be generally disposed adjacent to the throat portion 104 of the paddle, e.g., along each of the first side 108 and the second side 110 of the paddle 100, in or above or around the neck region. The second portion 150 may be connected to the first portion 140. The second portion 150 may also be connected to the handle 120. That is, in some aspects, the second portion 150 couples the first portion 140 and the top end 122 of the handle 120. At least in some portions of the second portion 150 of the frame 130, the second portion 150 may include a second thickness T2 that is less than the first thickness T1. By way of example, the first thickness T1 may be about the same thickness of the paddle 100 overall—e.g., minus a thickness of the first face 101 and the second face—and, by way of further example, paddles may have a thickness ranging from about 12 mm to about 18 mm, but there are thinner and thicker paddles. Thus, the first thickness T1 may be in the range of about 12 mm to about 18 mm, ±1 mm. And, by way of example, the second thickness T2 may be around 20% to 70% of the first thickness T1. Other dimensions are also or instead possible without departing from the scope of this disclosure.

Figure 3:
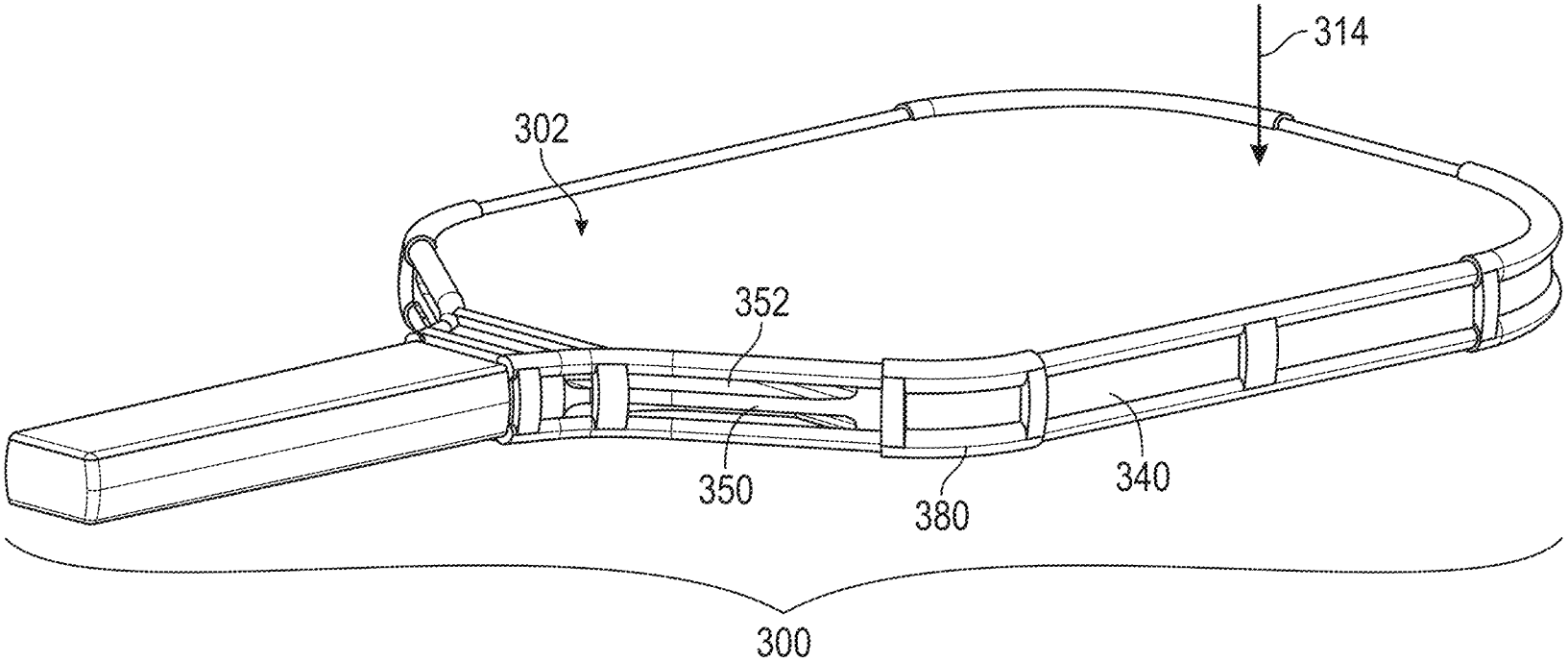
FIG. 3 shows a pickleball paddle, in accordance with a representative example.

The second thickness T2 may be selected to provide a predetermined flex between the top side 112 of the paddle 100 and the bottom end 124 of the handle 120 when a predetermined force normal to one of the first face 101 and the second face is applied (e.g., where the force is applied along one of the faces of the paddle 100 adjacent to the top side 112 of the paddle 100)—e.g., a force applied in the direction of arrow 314 shown in FIG. 3 in an area bordered by the first portion of the frame. The predetermined force may be representative of the force of striking a ball, and the normal direction may be considered a hit at normal incidence to one of the faces, or the normal force component of a hit at an angled incidence to the face. Also or instead, the second thickness T2 may be selected to provide a predetermined flex between the top side 112 of the paddle 100 and the bottom end 124 of the handle 120 when corresponding forces are applied at each of these locations. That is, the paddle 100 may bend a predetermined amount such that the top side 112 of the paddle 100 and the bottom end 124 of the handle 120 are displaced a predetermined amount from their at-rest positions when undergoing predetermined forces. Also or instead, from any of the previously described flexed positions, or otherwise flexed positions of the paddle 100, the first thickness T1 and/or the second thickness T2 may be selected to provide a predetermined speed of return to its unflexed state. It will be understood that any of the previously described flexing and/or return from flexing can be adjusted/modified with alternative constructions of the present teachings without departing from the scope of this disclosure.

As discussed above, in some aspects, the frame 130 includes a handle portion forming at least part of the top end 122 of the handle 120. The handle portion of the frame 130 may include portions that are thicker than the second thickness T2. For example, the handle portion of the frame 130 may include portions having at least the first thickness T1.

The second portion 150 may define one or more gaps 152 between the first face 101 and the second face along the edge portion 106 of the paddle 100. That is, the second thickness T2 of the second portion 150 may provide for the formation of one or more gaps 152 between the first face 101 and the second face along the edge portion 106 of the paddle 100. The gaps 152 may be voids that can be left empty for providing a lighter paddle 100, and/or filled with material to provide certain characteristics. For example, in some aspects, at least one of the one or more gaps 152 include a filler material at least partially filling a gap 152. And, by way of example, the filler material may include a material structurally configured to dampen vibration of the paddle 100 (as felt on the handle 120) when striking a ball. Also or instead, the filler material may include a material structurally configured to dampen sound made from contact between the paddle 100 and an object such as a ball. By way of example, such previously described filler materials may include one or more of the following: ethyl vinyl acetate (EVA), polyurethane (PU), silicone, a rubber, a plastic, cork, foam (e.g., neoprene foam, polyethylene foam, memory foam, nitrile foam, expanded polypropylene foam (EPP), EPDM foam, aerogel foam, and/or the like), sorbothane, gel, air or another fluid (e.g., an air bag or similar), and so on. The filler material may also or instead include one or more of a foam, a sponge, and/or any porous or low density structure, where any of these may be formed of one or more of the previously listed materials. In general, any material with relatively high hysteresis may be used. The filler material may also or instead be used for aesthetic purposes and/or informational purposes, such as where a certain color, pattern, texture, markings, and the like provide a pleasing look and/or convey to a user certain properties of the paddle 100.

The second thickness T2 may be formed in one or more of a plurality of ways, e.g., during manufacturing of the paddle 100 and/or frame 130. For example, the second thickness T2 may be formed by removal of material from the frame 130 along the second portion 150. This may include interior portions of the second portion 150 and/or exterior portions of the second portion 150. By way of example, a CNC machine or similar may be used to remove material from the frame 130 along the second portion 150 to establish at least portions thereof having the second thickness T2. By way of further example, a core portion of the frame 130 along the second portion 150 may be removed or otherwise be absent from the second portion 150—e.g., a honeycomb core or other core may be removed or omitted (e.g., cores such as any described in U.S. Pat. App. Pub. No. 2025/0073549 filed on Nov. 13, 2023 and incorporated by reference herein). The second thickness T2 may also or instead be formed by an absence of material from the frame 130 along the second portion 150. For example, less material may be used when forming the second portion 150 relative to the first portion 140. The second thickness T2 may also or instead be formed by preventing expansion of material disposed within the second portion 150 during a manufacturing process. By way of example, the frame 130 (or otherwise the paddle 100) may include a foam core that is expandable (e.g., through applied heat), where this foam material is prevented from expanding along the second portion 150 during manufacturing. By way of example, one or more portions of the frame 130 may be prevented from expanding using a mold to provide its desired shape—e.g., where, once the material (e.g., resin) is cured and the shape is formed, the mold is removed. Other techniques for forming the second thickness T2 relative to the first thickness T1 are also or instead possible.

The frame 130, or more generally the paddle 100, may further include a first transition region 160 disposed between the first portion 140 and the second portion 150. In some aspects, the first transition region 160 includes a sloped portion (e.g., a sloped face gradually transitioning from the region of the first thickness T1 to the region of the second thickness T2). Also or instead, the first transition region 160 may include one or more cutouts forming at least one step between the first thickness T1 and the second thickness T2.

The frame 130, or more generally the paddle 100, may further include a second transition region 170 disposed between the second portion 150 and the handle portion of the frame 130, or otherwise between the second portion 150 and the top end 122 of the handle 120. The second transition region 170 may be the same as or similar to the first transition region 160, e.g., in size, shape, and/or material. For example, the second transition region 170 may include a sloped portion. Also or instead, the second transition region 170 may include one or more cutouts forming at least one step between the second portion 150 and the handle portion of the frame, or otherwise the top end 122 of the handle 120.

The frame 130 may be made of one or more materials. For example, in an aspect, the frame 130 may be made of a single material such that the first portion 140 and the second portion 150 are made from the same material. In other aspects, at least some of the first portion 140 includes a different material than at least some of the second portion 150. And, in some aspects, one or more of the first portion 140 and the second portion 150 include at least two materials therein. For example, one or more of the first transition region 160 and the second transition region 170 may include a different material than other portions of one or more of the first portion 140 and the second portion 150.

The frame 130, or other portions of the paddle 100, may include one or more of the following materials: carbon, glass, a synthetic or natural fiber with resin, plastic, rubber, metal, and/or any material that provides a substantially rigid structure. By way of example, the frame 130 may include carbon fiber, with a thermoset resin (e.g., epoxy and/or polyester) and/or with a thermoplastic resin (e.g., PP and/or PE). The frame 130 can be of any cross-sectional shape, height, width, and length. It can be a single piece or it can be split into two, three, or more sections with the same or different geometries and dimensions. The frame 130 can surround the entire paddle 100, just the head, just the handle 120, or just specific areas. The paddle 100 may also or instead include one, two, three, four, or more layers of unidirectional or weave of carbon, glass, or any natural or synthetic fiber and prepreg impregnated with any kind of resin; an open-cell structure or lattice (e.g., honeycomb) of polypropylene, aluminum, Nomex® (registered trademark of affiliates of DuPont de Nemours, Inc.), aromatic polyamide fiber, or any other synthetic or natural material; and the like.

Thus, the present teachings may include a flexible paddle and/or flexible frame. For example, in an aspect, the present teachings include a frame for a pickleball paddle, the frame including: a handle portion structurally configured to form at least part of a handle of the pickleball paddle; a first portion disposed above the handle portion, the first portion forming at least part of a first side, a second side, and a top side to define at least part of a shape of a perimeter of the pickleball paddle, the first portion having a first thickness; and a second portion disposed between and coupling the first portion and the handle portion, the second portion having a second thickness that is less than the first thickness.

As described herein, the present teachings may include a pickleball paddle having advantageous flexibility compared to traditional paddles. This advantageous flexibility and other related properties may be accomplished through the inclusion of a frame having a first portion with different flexibility than a second portion as described herein, along a region of interest for the paddle such as a neck disposed adjacent to or otherwise near a throat portion of the paddle. The differences in flexibility between the first and second portion may be accomplished in one or more ways. For example, using materials with different properties, and/or using the same material but with different structures to change the properties thereof relative to one another. By way of example, the first and second portions may have different thicknesses as described herein. Also or instead, the first and second portions may include different materials having different flexibilities. By way of example, the first and second portions may have the same thickness, but where these portions include different materials that provide the different flexibilities. By way of further example, the first and second portions may have the same thickness but the strengths of these portions may be different—e.g., the second portion may be weaker (e.g., by using two layers of carbon fiber tube for the frame generally, but using only one layer in an area where the second portion is disposed).

Thus, in an aspect, a frame for a pickleball paddle may include: a handle portion structurally configured to form at least part of a handle of the pickleball paddle; a first portion disposed above the handle portion, the first portion forming at least part of a first side and a second side of the pickleball paddle, the first portion having a first elasticity along at least part of the first side and the second side of the pickleball paddle; and a second portion disposed between and coupling the first portion and the handle portion, at least part of the second portion having a second elasticity that is greater than the first elasticity.

In an aspect, the first portion is made from the same material as the second portion, and the first elasticity being less than the second elasticity is provided by a difference in one or more of a size and a shape between the first portion and the second portion. In certain aspects, the difference in one or more of the size and the shape between the first portion and the second portion is formed by removal of material along the second portion and/or omission of such material. And, in certain aspects, the difference in one or more of the size and the shape between the first portion and the second portion is also or instead formed by preventing expansion of material disposed within the second portion during a manufacturing process. Also or instead, in an aspect, the first portion includes a first material and the second portion includes a second material that is different than the first material, the second material having the second elasticity that is greater than the first elasticity of the first material.

FIG. 3 shows a pickleball paddle, in accordance with a representative example. That is, FIG. 3 shows a system 300 including a paddle 302 and an edge guard 380, which can be integral with, or separable from, the paddle 302. The paddle 302 may be the same or similar to those described above with reference to FIGS. 1 and 2, for example, including a frame that is similar to those described above.

The edge guard 380 may be disposed over at least a portion of one or more of the first portion 340 of the frame and the second portion 350 of the frame. Stated otherwise, the system 300 may include an edge guard 380 disposed over at least part of the second portion 350 of the frame. The edge guard 380 may define a void exposing (e.g., leaving visible) at least one of the one or more gaps 352 along the edge portion of the paddle 302, and/or may expose material filling at least a portion of these gaps 352.

Figure 4:
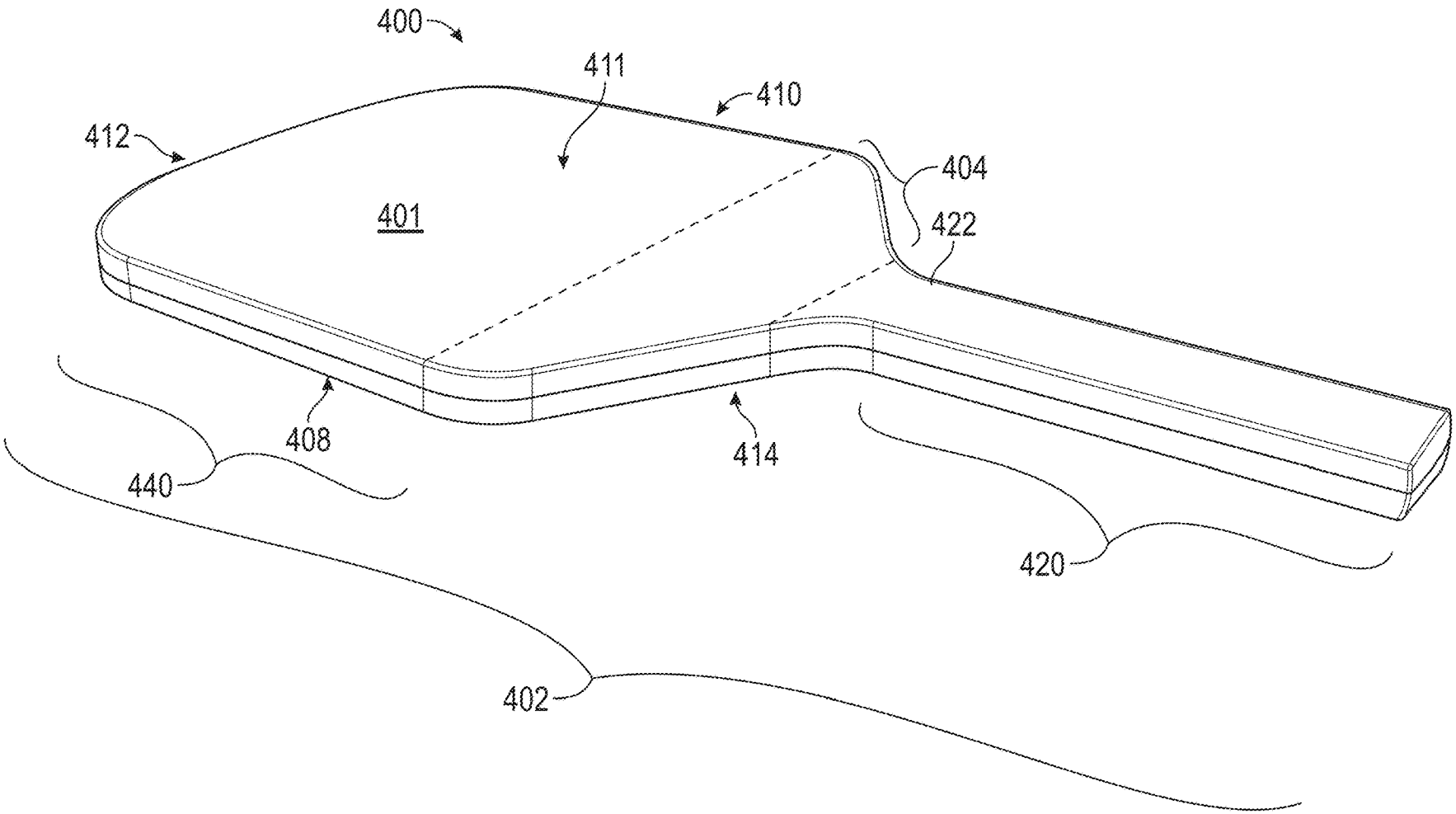
FIG. 4 shows a pickleball paddle, in accordance with a representative example.

FIG. 4 shows a pickleball paddle, in accordance with a representative example. The paddle 400 may include one or more features of one or more of the other paddles described elsewhere in this disclosure. However, different from some of the other paddles described herein, the paddle 400 of FIG. 4 may lack a frame, but may still similarly provide advantageous flexing over existing paddles. Thus, it will be understood that the present teachings can include embodiments of paddles with or without frames.

The paddle 400 may include a body 402 that forms a structure or housing of the paddle 400. The body 402 may be structurally configured for coupling a first face 401 and a second face thereto. In this manner, the paddle 400 may further include a first face 401 and a second face each engaged with the body 402. Alternatively, the faces of the paddle 400 may be integral with the body 402, such that the body 402 includes each of the first face 401 and the second face thereon. As discussed above, the body 402 may lack a frame. Alternatively, in certain aspects, the paddle 400 may further include a frame coupled to the body 402.

In general, the body 402 may include a first side 408, a second side 410 opposing the first side 408, a top side 412, and a bottom side 414 opposing the top side 412. The bottom side 414 may be structurally configured for engagement with a top end 422 of a handle portion 420. For example, in some aspects, the body 402 further includes at least the top end 422 of the handle portion 420, and in some instances the body 402 further includes the handle portion 420 (e.g., the entire handle portion 420 forming a handle for the paddle 400). In this manner, the paddle 400 may have a unibody construction, with a head portion and handle comprised as a single piece. However, it will be understood that, in some aspects, the handle portion 420 is separate from the body 402, and coupled to the body 402 during manufacturing of the paddle 400.

The paddle 400, and more specifically the body 402 of the paddle 400, may include a neck region 404 extending upwards from the bottom side 414 of the body 402. In some aspects, the neck region 404 generally corresponds to a throat portion of the paddle 400, or otherwise a portion of the body 402 disposed above the handle portion 420, but below the top side 412 of the body 402.

A first portion 440 of the body 402 may be disposed above the neck region 404. By way of example, in some aspects, the first portion 440 extends to the top side 412 of the body 402 as shown in the figure. In other aspects, the first portion 440 is merely one or more discreet areas of the body 402 disposed above and/or below the neck region 404. At least some of the first portion 440 may have a first elasticity, where at least a portion of the neck region 404 has a second elasticity that is different from (e.g., greater than) the first elasticity. That is, the first portion 440 of the body 402 may include one or more features of the other first portions described herein, and the neck region 404 may include one or more of the features of the second portions described herein. And thus, in general, the neck region 404 may be more elastic than other portions of the body 402, which can aid in providing advantageous flexing of the body 402 when the paddle 400 is used during pickleball play.

In some aspects, the first portion 440 is made from substantially the same material as the portion of the neck region 404 having the second elasticity. In such aspects, the first elasticity being different from (e.g., less than) the second elasticity may be provided by a difference in one or more of a size and a shape between the first portion 440 and the portion of the neck region 404 having the second elasticity. By way of example, the difference in one or more of the size and the shape between the first portion 440 and the portion of the neck region 404 having the second elasticity may be formed by removal of material, or otherwise a lack of material, along at least one of: the first side 408, the second side 410, a top surface 411, and a bottom surface opposing the top surface 411. Also or instead, by way of further example, the difference in one or more of the size and the shape between the first portion 440 and the portion of the neck region 404 having the second elasticity may be formed by preventing expansion of material disposed within the portion of the neck region 404 during a manufacturing process.

In some aspects, the first portion 440 may include a first material and a portion of the neck region 404 may include a second material that is different than the first material, where the second material has the second elasticity that is different from (e.g., greater than) the first elasticity of the first material. Also or instead, the first portion 440 may include a first material and a portion of the neck region 404 may lack the first material, where the first material provides for the first elasticity of the first portion 440. By way of example, the first portion 440 may include one or more core materials (e.g., a foam, a honeycomb structure, and the like), and the neck region 404 may lack one or more of these core materials. Also or instead, the neck region 404 may include a different core material than the first portion 440, and/or a different shape or internal structure of its core relative to the first portion 440. For example, the neck region 404 may include one or more voids (e.g., where such voids can be filled with a fluid such as air, or another substance, fluid or otherwise), where the first portion 440 lacks such voids or has different characteristics of corresponding voids (e.g., one or more of a different size, shape, material filled within, and so on).

The neck region 404 may extend into the bottom side 414 of the body 402. Stated otherwise, in some aspects, at least a part of the bottom side 414 of the body 402 includes the neck region 404. In this manner, in such aspects or otherwise, at least a part of the bottom side 414 of the body 402 may include one or more portions having the second elasticity. Alternatively, in some aspects, at least a part of the bottom side 414 of the body 402 includes one or more portions having the first elasticity that is different from (e.g., less than) the second elasticity of at least some portion of the neck region 404. Similarly, in some aspects, at least part of the handle portion 420 includes an elasticity that is less than the second elasticity—e.g., at least part of the handle portion 420 may include the first elasticity.

As described above, in some aspects, the body 402 includes each of the first face 401 and the second face thereon. In this manner, it will be understood that, to achieve desired flexibility for the paddle 400, one or more of the first face 401 and the second face may include one or more of the features described herein along one or more different regions to create or aid in desired flexibility. By way of example, a portion of one or more of the first face 401 and the second face may include a different material than a different portion thereof, where this material difference provides for desired flexing of the paddle 400.

Figure 5:
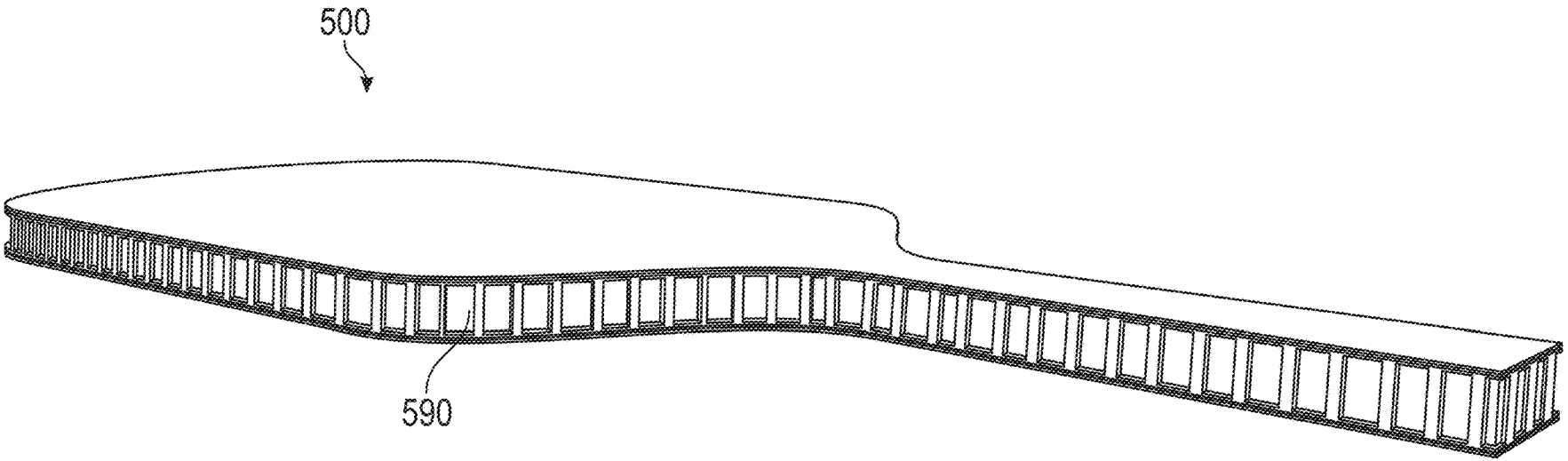
FIG. 5 shows a pickleball paddle, in accordance with a representative example.

FIG. 5 shows a pickleball paddle, in accordance with a representative example. The paddle 500 in this figure is shown with an exposed core 590 for clarity and understanding. And, as described herein, the core 590 may be specifically tailored to provide a first portion and second portion of the paddle having different elasticities or other material properties that can provide for advantageous flexing of the paddle 500 (e.g., desired speed of return from a flexed state to an unflexed state) as described herein. In some aspects, removal of one or more portions of the core 590 may provide for the elastic properties of the corresponding portions of the paddle 500.

Figure 6:
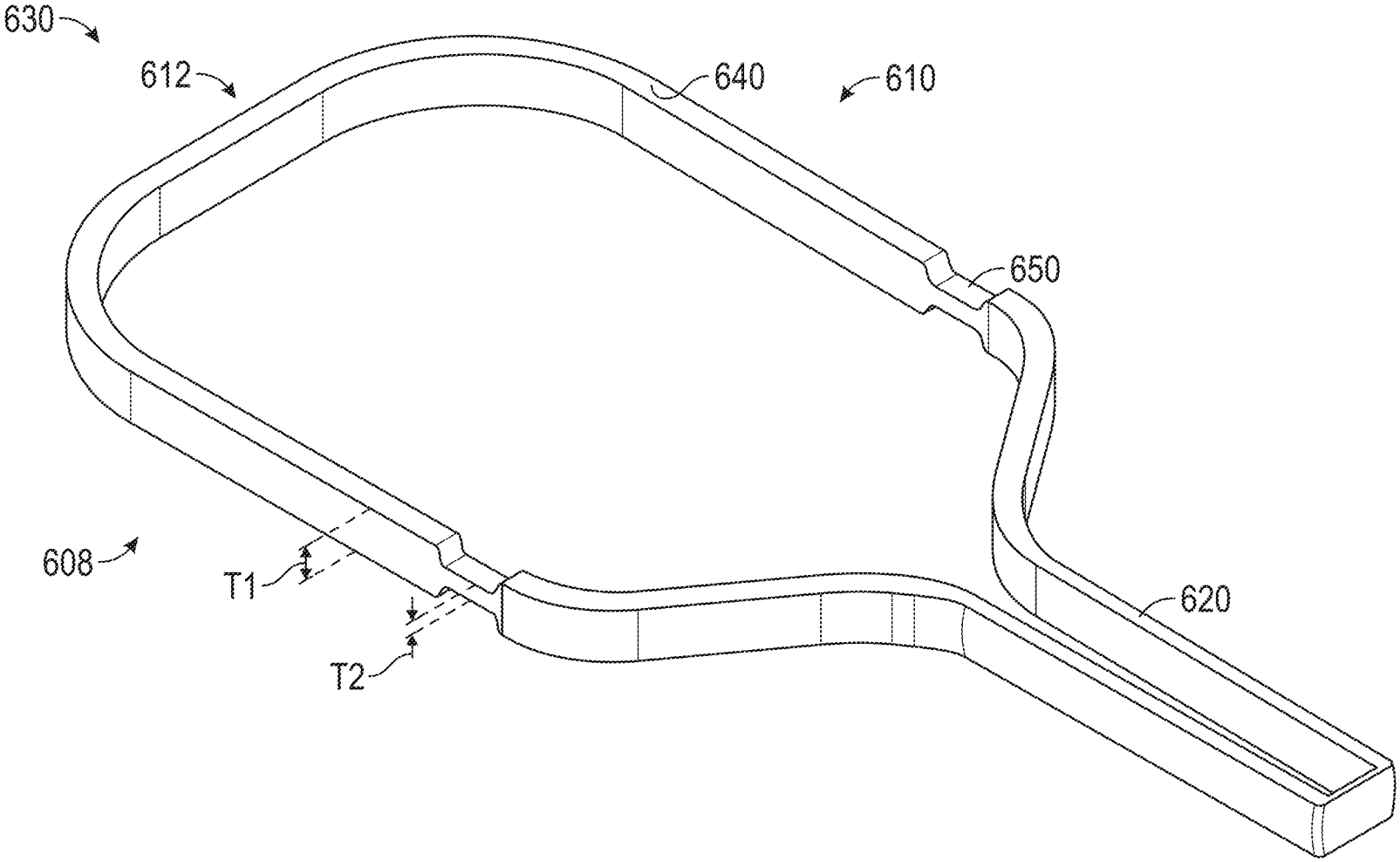
FIG. 6 shows a frame for a pickleball paddle, in accordance with a representative example.

FIG. 6 shows a frame 630 for a pickleball paddle, in accordance with a representative example. The frame 630 may include features that are the same as, or similar to, other frames described herein, such as the frame 130 of FIG. 1 and FIG. 2. The frame 630 includes a first side 608, a second side 610, a top side 612, a handle portion 620, a first portion 640, and a second portion 650. The first portion 640 may be disposed above the handle portion 620, and may form at least a part of the first side 608, the second side 610, and the top side 612. The second portion 650 may be disposed between the first portion 640 and the handle portion 620. In an aspect, more than one second portion may be present and each may be disposed between the first portion 640 and the handle portion 620 (e.g., one second portion 650 on the first side 608 and another second portion 650 on the second side 610). In the shown example, the first portion 640 has a first thickness, T1, and the second portion 650 has a second thickness, T2, that is less than the first thickness, T1. As described with reference to other examples given herein, the first portion 640 and the second portion 650 may have differing material properties (e.g., elasticity) in addition to, or instead of, differing thicknesses.

The second portion 650 of the frame 630 may be generally disposed adjacent to the throat portion of the paddle, e.g., along each of the first side 608 and the second side 610 of the frame 630, in or above the neck region. The second portion 650 may be connected to either, or both, of the first portion 640 and the handle portion 620 (and may couple the first portion 640 and the handle portion 620). The thickness of the second portion 650 may vary; for example, the second portion 650 shown may include the region having second thickness T2 and extend therefrom to the handle portion 620 (where the thickness in parts of the second portion 650 may be greater than T2 or may be substantially the same as T1). In some aspects, the second portion 650 may have the thickness T2 over its entire length. In some aspects, one or more additional portions may be present between the second portion 650 and the handle portion 620.

Thus, described herein are pickleball paddles and/or frames or other portions thereof that provide advantageous flexing. In implementations, this includes a paddle with a more elastic portion disposed at or near a neck region of a paddle. However, it will be understood that, in alternative aspects still falling within the scope of the present teachings, a paddle may include a stiffer (i.e., less elastic) portion disposed at or near a neck region of a paddle. Therefore, more generally, it will be understood that the present teachings include paddles with regions having different elasticities and/or other material properties to provide a desired flexing for the paddles.

Figure 7:
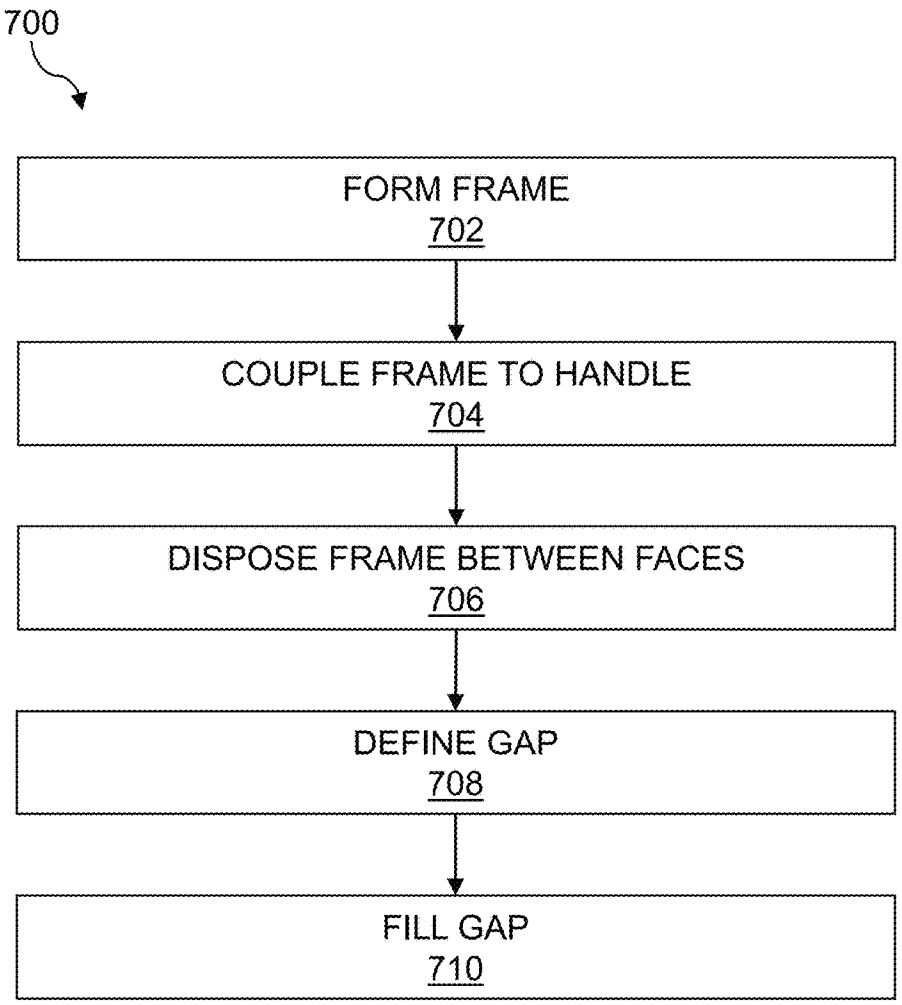
FIG. 7 shows a flow chart of a method for forming a paddle, according to a representative example.

FIG. 7 shows a flow chart of a method 700 for forming a paddle, according to a representative example. The method 700 may include a series of steps for constructing a paddle with various components—e.g., any one or more of the paddles described herein.

As shown in step 702, the method 700 may include forming a frame. The frame may at least partially define a shape of a perimeter of the paddle. The frame may include features of any of the frames described herein (e.g., the frame 630 of FIG. 6) such as a throat portion structurally configured for engagement with a top end of a handle; a first portion disposed above the throat portion along a first side, a second side, and a top side of the paddle, the first portion having a first thickness; and a second portion disposed adjacent to the throat portion along the first side and the second side of the paddle, and the second portion having a second thickness that is less than the first thickness.

As shown in step 704, the method 700 may include coupling the frame to the top end of the handle. In some aspects, this step may be part of step 702, forming the frame, as the frame may define a perimeter of the handle (e.g., the first portion, the second portion, and the handle may be unitarily formed). This step may further include coupling other features that may be desirable for a complete paddle, such as handle foam, handle grips, an end cap, and the like.

As shown in step 706, the method 700 may include disposing the frame between a first face and a second face along at least a portion of the perimeter of the paddle, where each of the first face and the second face are structurally configured for striking a ball (e.g., the first face and second face may be playing surfaces of the paddle). This step may include coupling the first face and the second face to the frame using techniques described herein (e.g., adhering the faces directly to the frame).

As shown in step 708, the method 700 may include defining one or more gaps between the first face and the second face along the second portion of the frame. This step may include, for example, removing material from a region of the frame to form a thinner portion relative to other portions of the frame or other manufacturing techniques that can create a gap (e.g., by using less material, by omitting material, by preventing expansion of material within this region during manufacturing).

As shown in step 708, the method 700 may include at least partially filling at least one of the one or more gaps with a filler material. By way of example, the filler material may include a material structurally configured to dampen vibration of the paddle when striking a ball. Also or instead, the filler material may include a material structurally configured to dampen sound, provide weight, or provide other desirable material properties. Examples of such materials are described above herein.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings.

Unless the context clearly requires otherwise, throughout the description, the words "comprise," "comprising," "include," "including," and the like are to be construed in an inclusive sense as opposed to an exclusive or exhaustive sense; that is to say, in a sense of "including, but not limited to." Additionally, the words "herein," "hereunder," "above," "below," and words of similar import refer to this application as a whole and not to any particular portions of this application.

It will be appreciated that the devices, systems, and methods described above are set forth by way of example and not of limitation. For example, regarding the methods provided above, absent an explicit indication to the contrary, the disclosed steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The method steps of the implementations described herein are intended to include any suitable method of causing such method steps to be performed, consistent with the patentability of the following claims, unless a different meaning is expressly provided or otherwise clear from the context. So, for example performing the step of X includes any suitable method for causing another party such as a remote user, a remote processing resource (e.g., a server or cloud computer) or a machine to perform the step of X. Similarly, performing steps X, Y, and Z may include any method of directing or controlling any combination of such other individuals or resources to perform steps X, Y, and Z to obtain the benefit of such steps. Thus, method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

While particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. A pickleball paddle, the paddle comprising:

a handle including a top end and a bottom end;

a first face and a second face that opposes the first face, each of the first face and the second face extending from a throat portion engaged with the top end of the handle, and each of the first face and the second face structurally configured for striking a ball; and a frame disposed between the first face and the second face along at least a portion of a perimeter of the paddle, the frame at least partially defining a shape of the perimeter of the paddle, the frame comprising:

a first portion disposed above the throat portion along a first side, a second side, and a top side of the paddle, the first portion having a first thickness; and a second portion disposed adjacent to the throat portion along the first side and the second side of the paddle, the second portion coupling the first portion and the top end of the handle, and the second portion having a second thickness that is less than the first thickness such that a first gap is formed above the second portion in-between the second portion and a plane disposed along the first face, and a second gap is formed below the second portion in-between the second portion and a plane disposed along the second face, wherein at least one of the first gap and the second gap include a filler material at least partially filling the gap.

2. The paddle of claim 1, wherein the second thickness is selected to provide a predetermined flex between the top side of the paddle and the bottom end of the handle when a predetermined force is applied normal to one of the first face and the second face.

3. The paddle of claim 1, wherein the filler material includes one or more of: a material structurally configured to dampen vibration of the paddle when striking the ball, and a material structurally configured to dampen sound of the paddle striking the ball.

4. The paddle of claim 1, further comprising an edge guard disposed over at least part of the second portion of the frame, the edge guard defining a void exposing at least one of the first gap and the second gap along an edge portion of the paddle.

5. The paddle of claim 1, further comprising an edge guard disposed over at least a portion of one or more of the first portion of the frame and the second portion of the frame.

6. The paddle of claim 1, further comprising a first transition region disposed between the first portion and the second portion, the first transition region including one or more of: a sloped portion, and one or more cutouts forming at least one step between the first thickness and the second thickness.

7. The paddle of claim 1, wherein the frame further includes a handle portion forming at least part of the top end of the handle.

8. The paddle of claim 7, wherein the handle portion is thicker than the second thickness.

9. The paddle of claim 1, wherein the second thickness is formed by one or more of: removal of material from the frame along the second portion, an absence of material from the frame along the second portion, and preventing expansion of material disposed within the second portion during a manufacturing process.

10. The paddle of claim 1, wherein the first portion and the second portion are integrally formed as a single continuous structure.

11. The paddle of claim 1, wherein the filler material includes one or more of a foam and a sponge.

12. A frame for a pickleball paddle, the frame comprising:

a handle portion structurally configured to form at least part of a handle of the pickleball paddle;

a first portion disposed above the handle portion, the first portion forming at least part of a first side, a second side, and a top side to define at least part of a shape of a perimeter of the pickleball paddle, the first portion having a first thickness measured in a direction between a first face and a second face of the pickleball paddle when the frame is disposed therebetween;

a second portion disposed between and coupling the first portion and the handle portion, the second portion having a second thickness measured in the direction between the first face and the second face of the pickleball paddle when the frame is disposed therebetween, wherein the second thickness of the second portion is less than the first thickness of the first portion thereby defining a recess along the second portion relative to the first portion; and a filler material disposed within the recess of the second portion.

13. The frame of claim 12, wherein the second thickness is selected to provide a predetermined flex between the top side of the pickleball paddle and a bottom end of the handle portion.

14. The frame of claim 12, further comprising a first transition region disposed between the first portion and the second portion.

15. The frame of claim 12, wherein the handle portion is thicker than the second thickness.

16. The frame of claim 12, further comprising a second transition region disposed between the second portion and the handle portion, wherein the second transition region includes one or more of: a sloped portion, and one or more cutouts forming at least one step between the second portion and the handle portion.

17. The frame of claim 12, wherein the second thickness is formed by one or more of: removal of material from the frame along the second portion, an absence of material from the frame along the second portion, and preventing expansion of material disposed within the second portion during a manufacturing process.

18. The frame of claim 12, wherein the first portion and the second portion are integrally formed as a single continuous structure.

19. A method of forming a paddle, the method comprising:

forming a frame at least partially defining a shape of a perimeter of the paddle, the frame comprising:

a throat portion;

a first portion disposed above the throat portion along a first side, a second side, and a top side of the paddle, the first portion having a first thickness; and a second portion disposed adjacent to the throat portion along the first side and the second side of the paddle, and the second portion having a second thickness that is less than the first thickness;

disposing the frame between a first face and a second face along at least a portion of the perimeter of the paddle, each of the first face and the second face structurally configured for striking a ball, wherein, when the frame is disposed between the first face and the second face, a first gap is formed above the second portion in-between the second portion and a plane disposed along the first face, and a second gap is formed below the second portion in-between the second portion and a plane disposed along the second face; and at least partially filling at least one of the first gap and the second gap with a filler material.

20. The method of claim 19, wherein the filler material includes one or more of: a material structurally configured to dampen vibration of the paddle when striking the ball, and a material structurally configured to dampen sound of the paddle striking the ball.

* * * * *